US006196932B1

(12) United States Patent
Marsh et al.

(10) Patent No.: US 6,196,932 B1
(45) **Date of Patent: *Mar. 6, 2001**

(54) INSTRUMENTED SPORTS APPARATUS AND FEEDBACK METHOD

(76) Inventors: Donald James Marsh, 66 Scarsdale Rd., Dennis, MA (US) 02638; Andrew John Marsh, 67 Warren St., Needham, MA (US) 02192

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/925,234

(22) Filed: Sep. 8, 1997

Related U.S. Application Data

(60) Provisional application No. 60/024,716, filed on Sep. 9, 1996.

(51) Int. Cl.[7] ..... A63B 57/00; A63B 69/36

(52) U.S. Cl. ..... 473/223; 473/221; 473/219; 473/222; 473/225; 473/151; 473/152; 473/409; 473/145; 310/318; 310/319; 310/320; 310/338; 395/500.05; 702/138; 702/189

(58) Field of Search ..... 473/223, 222, 473/221, 224, 225, 220, 219, 409, 140, 141, 143, 145, 146, 151, 152, 153, 154, 155, 156, 231; 310/338, 320, 318, 319, 311; 702/138, 151, 176, 189; 395/500.05

(56) References Cited

U.S. PATENT DOCUMENTS

| | | | | |
|---|---|---|---|---|
| 3,717,857 | | 2/1973 | Evans | 340/177 R |
| 3,792,863 | | 2/1974 | Evans | 273/186 A |
| 4,659,090 | * | 4/1987 | Kustanovich | 273/376 X |
| 4,822,042 | | 4/1989 | Landsman | 273/73 R |
| 4,834,376 | | 5/1989 | Steinberg | 273/26 B |
| 4,898,389 | * | 2/1990 | Plutt | 273/186 A X |
| 4,940,236 | | 7/1990 | Allen et al. | 273/183 D |
| 5,131,660 | | 7/1992 | Marocco | 273/186 A |
| 5,209,483 | | 5/1993 | Gedney et al. | 273/187.4 |
| 5,295,689 | * | 3/1994 | Lundberg | 273/167 H X |
| 5,310,185 | * | 5/1994 | Viollarz et al. | 273/167 H X |
| 5,487,542 | * | 1/1996 | Foley | 273/176 FA X |
| 5,586,940 | * | 12/1996 | Dorsch et al. | 473/140 X |
| 5,757,266 | * | 5/1998 | Rider et al. | 340/323 R X |

* cited by examiner

*Primary Examiner*—Valencia Martin-Wallace
*Assistant Examiner*—Binh-An Nguyen
(74) *Attorney, Agent, or Firm*—Testa, Hurwitz & Thibeault LLP

(57) ABSTRACT

An instrumented sports apparatus includes a closely spaced array of discrete sensor elements coupled to a contact surface thereof for converting a contact force between the contact surface and an object into a plurality of discrete output signals. The signals are processed and information based thereon generated, which is representative of one or more parameters of interest. In an exemplary embodiment, as instrumented golf club displays information such as club head speed, club head angle, and club head elevation upon impact with a golf ball, permitting the golfer to adjust his swing on the next stroke. Since the instrumentation and display are entirely self-contained in the club, a golfer is not constrained in the use of the club and may enjoy the benefits thereof during play on a golf course.

19 Claims, 5 Drawing Sheets

48a

| | 1 | 2 | 3 | 4 | 5 | 6 | 7 |
|---|---|---|---|---|---|---|---|
| A | | | | 20 | | | |
| B | | | 30 | 35 | 28 | | |
| C | | 18 | 40 | 45 | 35 | 12 | |
| D | | | 65 | 80 | 60 | | |
| E | | | 15 | 15 | 10 | | |
| F | | | | | | | |
| G | | | | | | | |

48a

| | 1 | 2 | 3 | 4 | 5 | 6 | 7 |
|---|---|---|---|---|---|---|---|
| A | | | | 20 | | | |
| B | | | 30 | 35 | 28 | | |
| C | | 18 | 40 | 45 | 35 | 12 | |
| D | | | 65 | 80 | 60 | | |
| E | | | 15 | 15 | 10 | | |
| F | | | | | | | |
| G | | | | | | | |

FIG. 9A

48b

| | 1 | 2 | 3 | 4 | 5 | 6 | 7 |
|---|---|---|---|---|---|---|---|
| A | | | | | | | |
| B | | | | | | | |
| C | | | | | | | |
| D | | | | | 10 | | |
| E | | | | 18 | 35 | 15 | |
| F | | | | 35 | 85 | 25 | |
| G | | | | | | | |

FIG. 9B

INSTRUMENTED SPORTS APPARATUS AND FEEDBACK METHOD

CROSS REFERENCE TO RELATED APPLICATION

This application claims priority under 35 U.S.C. §119(e) to U.S. Provisional Patent Application Ser. No. 60/024,716 filed in the U.S. Pat. and Trademark Office on Sep. 9, 1996.

TECHNICAL FIELD

The present invention relates to a sports apparatus and related training method and more particularly to an instrumented golf club for providing feedback to a user useful for controlling golf swing and golf ball contact.

BACKGROUND INFORMATION

Amateur golfers benefit from feedback regarding their golf swing to improve their consistency, performance, and satisfaction with the game. The golf swing and contact with the golf ball are difficult to execute, control, and repeat effectively. Electronic aids for providing feedback to the golfer have become increasingly popular for use on golf ranges and in home settings. These devices, however, cannot typically be used during actual play on a golf course as they generally require external support or control apparatus to measure, calculate, and display information useful for the golfer to facilitate guiding the club and controlling the swing. These electronic golf aids require that the golfer remember the correct stance, grip, and ball address and attempt to replicate these functions hours or days later when playing on the golf course.

Other portable devices have been described which provide the golfer with some information about the last contact with the golf ball. For example, U.S. Pat. No. 4,940,236 issued to Allen discloses a golf club including a transducer assembly of two piezoelectric films sandwiched across an entire face of a golf club head assembly between a club head and a face plate. A circuit assembly displays an estimated ball distance on a liquid crystal display by integrating an impact force curve over impact time to generate a ball velocity which is then correlated to an estimated distance value. Neither the point of contact on the face plate nor the spin of the ball, if any, can be determined. These parameters are known to effect significantly ball trajectory and distance. U.S. Pat. No. 5,209,483 issued to Gedney et al. discloses a golf club including five sensors, one each disposed in central, toe, heel, top, and bottom regions of a club head. A circuit detects a peak central sensor output to determine ball velocity and yardage. The peak output is compared to the peak outputs of the other four sensors to determine generally location of the hit on the club head. Ball trajectory is determined by comparing the peak outputs of the toe and heel sensors.

There exists a need for a self-contained instrumented sports apparatus capable of providing substantially instantaneous feedback to a user of multiple parameters of interest which collectively effect ball trajectory and distance. The invention disclosed hereinafter satisfies this need and represents a significant improvement in the art.

SUMMARY OF THE INVENTION

A method and apparatus are disclosed for providing feedback to a user of a sports apparatus having a surface for impacting an object such as a ball. In an exemplary embodiment, the sports apparatus includes a transducer coupled to the impact surface, the transducer having an array of discrete neighboring point sensors such that each point sensor generates a respective electrical analog output signal. Each output signal has a time-varying magnitude and duration corresponding to a local normal force due to the local impact of the surface by the object. The apparatus includes a circuit for processing the respective output signals and a display for displaying one or more parameters of interest corresponding to the respective output signals. The circuit may include an analog multiplexer for multiplexing the respective output signals, an analog-to-digital converter (ADC) for converting the multiplexed signals to digital data, and a processor for processing the digital data and generating information representative of the parameters of interest. The circuit may also include signal conditioning circuitry for amplification and filtering, if desired, as well as a battery for providing power. Parameters of interest may include impact speed, impact angle, and impact location which may be displayed numerically or graphically. In an exemplary embodiment, the sports apparatus is a golf club having a club head with a face for striking a golf ball. The transducer may be manufactured from a piezoelectric film material to produce the desired point sensor array having a sufficient density to generate a plurality of respective output signals for a typical impact. For the golf club application, parameters of interest may include club head speed, club head angle, and club head elevation. In an exemplary embodiment, the transducer, circuit, and display are fully integrated into the golf club.

According to the method of the invention, feedback is provided to the user of the sports apparatus by measuring object impact at a plurality of discrete points on the surface of the apparatus using a transducer for generating a plurality of respective output signals, processing the signals, and displaying at least one parameter of interest corresponding to the signals. In an exemplary embodiment, the processing step may include the steps of multiplexing the respective output signals, converting the multiplexed signals to digital data, and generating information representative of one or more parameters of interest based upon the digital data. Output signal conditioning including amplifying and filtering may be included, if desired. The information generating step may include sampling the digital data corresponding to each signal, averaging the sampled data for each signal, and comparing a distribution of the averaged data to stored data. This method may be used where the parameter of interest is impact angle, which may be displayed graphically. Where the parameter of interest is impact speed or impact location, the information generating step may include sampling the digital data corresponding to each signal and determining a maximum value of all of the sampled data. This method of converting the object impact into displays useful to the user of the sports apparatus is unique.

According to another method of the invention, a surface of a sports apparatus is instrumented by providing a transducer having a array of discrete point sensors and integrating the transducer into the sports apparatus such that the transducer is coupled to the surface and also protected from direct impact of an object striking the surface. The transducer may be a piezoelectric film which is coupled to the surface by bonding.

When employed in a golf club, the battery powered circuit may be built into the shaft of the club and the transducer and display may be built into the head of the club. Any club may be instrumented according to the invention, including drivers and putters. By using an instrumented club, a golfer can receive immediate feedback after each golf stroke and can modify his next swing, as necessary, to produce more accurate, reliable results.

The batteries and circuit may be contained in a housing configured to be inserted into the handle end of the golf club shaft. A cover may be provided at the end of the handle to facilitate battery replacement. A manual or automatic motion detection switch may also be provided to prevent depletion of the batteries when the club is not being used. The housing may optionally include the display, although the display may be mounted on an upper surface of the club head, proximate the transducer which is integrated into the club head. In alternative embodiments, the apparatus and method of this invention may be integrated into contact sports apparatus other than golf clubs, such as baseball bats, paddles, and racquets.

BRIEF DESCRIPTION OF THE DRAWINGS

The invention, in accordance with preferred and exemplary embodiments, together with further advantages thereof, is more particularly described in the following detailed description taken in conjunction with the accompanying drawings in which:

FIGS. 9A–9B are schematic representations of sensor array force matrices for two different impact conditions in accordance with an exemplary embodiment of the present invention.

MODE(S) FOR CARRYING OUT THE INVENTION

Figure 1:
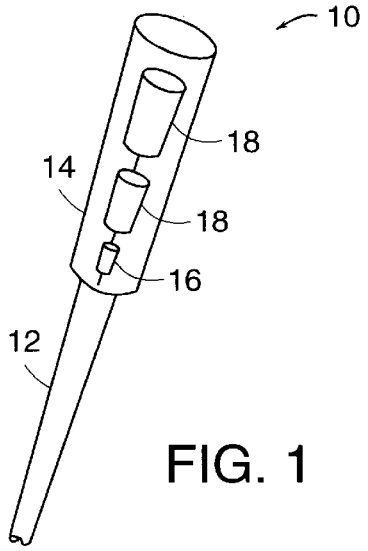
FIG. 1 is a schematic, perspective view of an upper portion of a golf club in accordance with an exemplary embodiment of the present invention.
Figure 2:
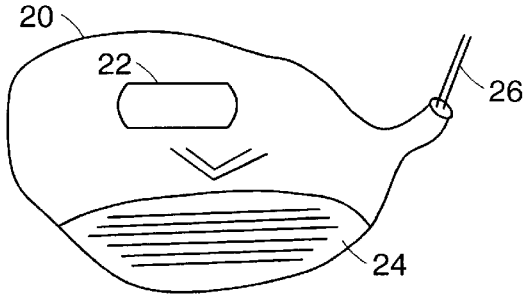
FIG. 2 is a schematic, perspective view of a lower portion of a golf club in accordance with an exemplary embodiment of the present invention.

Depicted in FIG. 1 is a schematic, perspective view of an upper portion of a golf club 10 including a shaft 12 and a grip 14. Disposed in the shaft 12 proximate the grip 14 is a housing or other structure for receiving a circuit, shown generally at 16, and a source of power such as batteries 18. A display 22 may be disposed in the shaft 12 proximate the grip 14 or alternatively may be built into an upper surface of a head 20 of the club 10 as depicted in FIG. 2. The head 20 of a wood or driver club is shown here for illustrative purposes, it being understood that the invention is applicable to iron clubs, as well as other sports apparatus such as bats racquets, sticks and the like. The display 22 may include alpha-numeric as well as graphical representations of one or more parameters of interest related to a the golf swing such as club head impact speed, impact angle, and impact location.

A transducer is integrated into the club head 20 and coupled with a face 24 of the club 10. Wiring 26 from the transducer is routed through the shaft 12 to the circuit 16. By configuring the transducer as an array of closely nested, discrete point sensors, a significant amount of information can be generated for each impact. For example, initial impact location can be determined closely, being a function of the density or spacing of the point sensors across the face 24 of the club 10 in both a horizontal and a vertical direction.

Figure 3A:
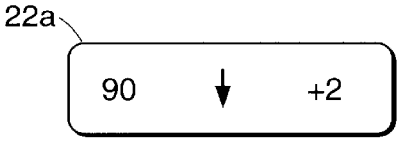
FIGS. 3A–3C are schematic, exemplary displays for three different impact conditions in accordance with an exemplary embodiment of the present invention.
Figure 3B:
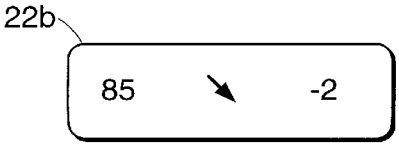
Figure 3C:
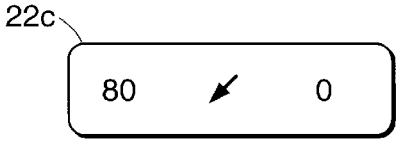

Exemplary displays 22*a*–22*c* of parameters of interest are depicted in FIGS. 3A–3C. Each display 22 includes a numerical representation of club head impact speed in miles per hour (mph), a graphical representation of impact angle, and a numerical representation of impact elevation. For these parameters of interest, two to three character positions are dedicated to displaying club head impact speed, one graphical character position is dedicated to displaying horizontal impact angle orthogonality, and two character positions are dedicated to displaying vertical impact elevation location. Any of a variety of displays can be employed, including light-emitting diodes (LEDs) or liquid crystal diodes (LCDs) depending on ambient light and power consumption considerations as will be discussed in greater detail hereinbelow.

Figure 4:
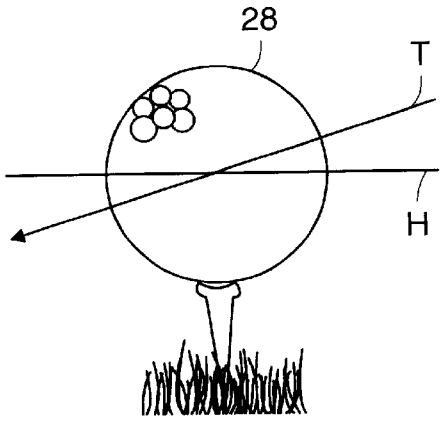
FIG. 4 is a schematic, side view of a golf ball subject to the impact condition of FIG. 3A.

Referring now to FIG. 3A, based on an exemplary golf swing, the speed at impact is presented in the display 22*a* as 90, representing that club head speed at impact with the ball is 90 mph. Based on secondary impact information as will be discussed in greater detail hereinbelow with respect to FIGS. 7A–8B, the direction of club travel is substantially perfectly orthogonal to the ball. This orthogonal impact angle is represented by an arrow normal to the display 22*a*. Accordingly, the ball will not be subject to side spin and can be expected to travel in a generally straight line down the fairway. The last parameter of interest, impact elevation, is depicted as "+2," meaning that club travel T resulted in the ball being struck initially with the bottom of the club face 24, about two millimeters above a horizontal centerline H of the ball 28, as depicted in FIG. 4. Such a high initial ball impact typically results in poor ball trajectory and distance, since vertical travel of a golf ball during its flight trajectory is a function of both the loft of the club and the location of club impact with respect to the horizontal centerline H of the ball. The loft of the club is a function of the angle of the face of the club relative to a vertical plane, with higher numbered irons having greater angles and resultant loft. By hitting the ball 28 above the centerline H, as depicted in FIG. 4, the ball 28 can be expected generally to travel both lower and a shorter distance than if the ball were hit properly, along the horizontal centerline H for a given club loft angle and impact speed.

FIG. 3B is a display 22*b* of another impact condition. Here, club head impact speed is slightly lower, being only 85 mph. Instead of striking the ball with a proper orthogonal impact angle, the swing is outside-in, which in conventional golf terminology means the club approaches the ball from a point outside the nominal ball target line and, as it hits the golf ball, imparts a right hand spin to the ball. The rotation of the ball during flight typically causes the ball to "slice," traveling in a right-hand curving motion off to the right of the fairway. This condition is represented graphically in the display 22*b* as an arrow canted to the right. The depiction ball also was struck low with the top of the club face 24, as indicated by the "−2" designation for impact elevation. In other words, this ball was struck by the club about 2 mm below the horizontal centerline H. As a result, the vertical travel of the ball typically will be greater than desired, again reducing horizontal travel distance of the ball.

Lastly, the display 22*c* of FIG. 3C indicates an even slower club head impact speed of only 80 mph. The depicted impact angle is from inside-out, meaning that the club head approaches the ball from left-to-right, imparting a left hand spin on the ball causing what is known as a "hook" or "draw." As a result, the ball can be expected to travel to the left hand side of the fairway, opposite that of the slice of display 22*b*. The greater the deviation of impact angle from orthogonal, the greater the resulting hook or slice. This ball, however, was hit along the horizontal centerline, as indicated by a value of zero for impact elevation. Accordingly, there will be no significant vertical bias to the trajectory of the ball other than that imparted by the loft of the club face.

Figure 6:
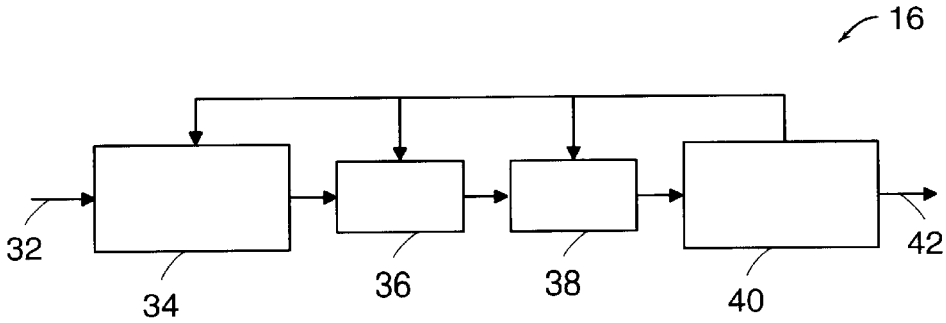
FIG. 6 is a schematic block diagram of a circuit for processing the transducer output signals in accordance with an exemplary embodiment of the present invention.

While the dynamics of the impact of the club head 20 with the ball 28 are multifaceted, parameters such as those mentioned above, as well as 'toe-center-heel' impact position appear to be of significant importance. Accordingly, it is desirable to be able to map substantially the entire face 24 of the club head 20 to collect relevant data. Equally important is the use of signal processing hardware and algorithms to convert the raw data efficiently and effectively to useful parameter information for substantially instantaneous display to the golfer. As will be discussed in greater detail hereinbelow with respect to FIG. 6, in an exemplary embodiment, the circuit 16 consists of an ADC for digitizing the analog output signals of the transducer and a microprocessor for processing the digital data and generating information representative of one or more parameters of interest for display.

As the club face 24 contacts the ball 28, an impulse force F is imparted to the ball 28. The principles of dynamics teach that the impulse force F is equal to the time integral of the club head momentum, as presented by the following equation:

$$f = \frac{m(v_i - v_f)}{\Delta t}$$

where m is the club head mass, $v_i$ is the initial club head speed at impact, $v_f$ is the final club head speed after impact, and $\Delta t$ is the time duration of the impact. An equivalent impulse force equation can be generated for the golf ball, although the equation can be simplified by dropping the $v_i$ term, since the initial velocity of the golf ball is equal to zero. Using these equations and given that the masses of the club head and golf ball are known, the impulse force and impulse duration can be measured to calculate respective values for club head speed and ball speed directly, without the need for a fixed frame of reference.

In an exemplary embodiment, the total impulse force F with which the ball 28 is struck can be measured using a piezoelectric film sensor, an accelerometer, or other force sensor. The time duration of the impact force can also be measured using a sufficiently high frequency microprocessor-based system for sampling the output of the force sensor. By integrating a plurality of discrete point sensors in an array or other suitable geometric pattern across the face 24 of the club head 20, then the exact location of the ball contact can also be identified and the force thereat measured. For example, if there are 50 sensors s on the face 24, by employing an ADC with a sampling rate r of $1\times10^6$ samples per second, the following equation yields the number of samples N for each sensor in a time interval t such as 0.5 milliseconds, which has been reported as being on the order of the duration of the time from initial club face contact with a golf ball to maximum impulse force and decay in a typical golf shot:

$$N = (1\times10^6)\times\left[\frac{0.5\times10^{-3}}{50}\right] = 10 \text{ samples/sensor}$$

The time-varying output of each of the multiple sensors can be used to provide precise initial and subsequent face contact information. For example, the golfer may be presented a display with printed or graphical initial face contact location information such as toe-center, center, center-heel or heel. Such a parameter of interest could be displayed in addition to or as an alternative to one or more of the parameters of interest displayed in FIGS. 3A–3C. Depending on a particular application, the transducer output signals may require signal conditioning such as amplification, filtering, or scaling. Further, since club head mass differs from one club to the next and expected club head velocity impact range differs for different clubs, the momentum equation and total force range could be tailored for each club, depending on make and model.

A plurality of clubs within a given set of clubs could be instrumented, as desired, to provide the golfer with real-time feedback regarding the effectiveness of his swing while on the golf course. This technology could also be utilized on other types of sports apparatus. As long as the mass properties of the sports apparatus and impact object are known and substantially constant, the characteristics of the impulse contact with the ball or other impact object can be measured and calculated to provide the user with real-time feedback of one or more parameters of interest.

Figure 5:
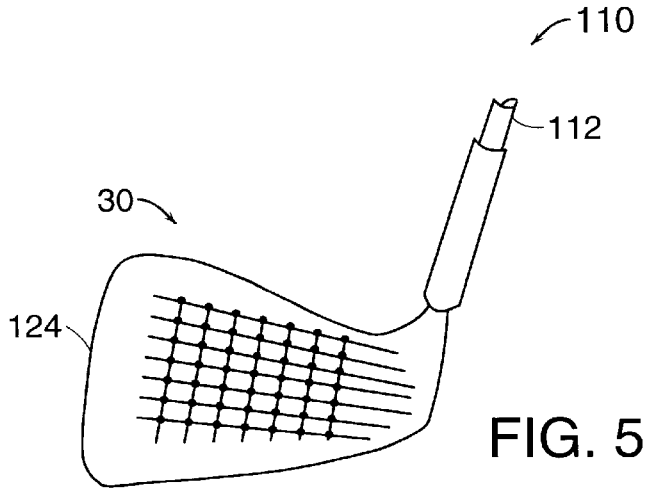
FIG. 5 is a schematic, front view of a golf club head instrumented with a transducer array in accordance with an exemplary embodiment of the present invention.

A suitable transducer for practicing the invention utilizes piezoelectric film. In an exemplary embodiment depicted in FIG. 5, a piezoelectric transducer 30 having forty-nine discrete sensor elements arranged in a seven-by-seven orthogonal array is coupled by bonding to an inside surface of the club face 124 with suitable wire connections soldered to each of the sensor elements in the array. The surface area of each element would be in the range of between about 0.002 $in^2$(0.013 $cm^2$) and about 0.014 $in^2$(0.090 cm). Center-to-center spacing between the sensor elements would be in the range of between about 0.010 inches (0.025 cm) and about 0.08 inches (0.20 cm). In an alternative embodiment, the transducer could be manufactured from a plurality of thin strips of piezoelectric film, overlapped or woven into a matrix of rows and columns, forming a plurality of junctions. Respective output signals could be measured at each of the junctions. In an exemplary embodiment, the strips could be about 0.016 inches (0.040 cm) in thickness, about 0.04 inches (0.10 cm) in width, and a length suitable for the apparatus surface being instrumented. While these ranges are suitable for golf club applications, both larger and smaller surface areas, spacings, and strip sizes are considered to be within the scope of the invention. Design factors include the size and contour of the surface of the sports apparatus to be instrumented and the size and deformation characteristics of the ball or other object subject to impact. The horizontal and vertical wire interconnections of the array carrying the analog output signals of the sensor elements are routed through the club shaft 112 to the circuit disposed proximate the grip for processing.

In alternative embodiments, the sensor elements may be configured in a variety of patterns other than orthogonal arrays, such as concentric circular patterns, diamond patterns, variable density patterns, or other configurations suitable for a particular application. It is generally preferred, however, that substantially the entire potential contact area of the surface be instrumented with sufficient density so that a plurality of sensor elements are activated by any impact on the surface adequate to determine the parameters of interest.

At the intersection of each vertical and horizontal wire in the array, an electrical output signal is generated corresponding to the magnitude and duration of local physical impact of the club face 124 with the ball. The transducer 30 would generate at each location an electric field intensity measured in Newton-meters per coulomb or volts. This electric field intensity is generated by the mechanical stress in the crystalline structure of the piezoelectric material caused by the local impact. Instead of being bonded to a protected side of the club face 124, the discrete piezoelectric sensor elements may be bonded to the contact side of the club face 124 and protected from direct impact by the golf ball by a thin sheet of stainless steel or other substantially incompressible material.

In order to preserve the design characteristics of the club 110, the sensor elements should be sufficiently stiff so as not to add significant elastic damping to the club face 124. A piezoelectric material is suitable, since the stiffness thereof is approximately five parts per million. Accordingly, the full range of impulse force would be scaled over a minimal range of deflection so that the stiffness of the film would not detract from the performance of the golf club. Impact forces for a driver are estimated at between about 2 kN (kilo-Newtons) and 5 kN, well within the capability of piezoelectric films. Both lower and higher forces applicable to other golf clubs and other sports apparatus may also be accommodated by such films. By measuring the force at impact, and the time duration of the total impulse, a value for the change in velocity of the club head can be calculated by using the impulse equation previously introduced here. The value of this velocity change, combined with the known masses of the club head and golf ball, can be used in a formula, with correlation factors determined empirically or by modeling, to estimate actual club head impact speed with great accuracy. Modeling has verified a linearly proportional relationship between the change in club head velocity and initial ball velocity as a function of the two masses involved. Golf ball travel distance can also be estimated based on initial ball velocity, although ambient environmental factors such as wind speed and direction, as well as ball spin, can affect the accuracy of such a distance calculation.

The piezoelectric transducer 30 coupled to the club face 124 produces multiple electrical signals, according to the number of sensors in the array, which are processed to generate information representative of one or more parameters of interest to be displayed for the benefit of the golfer. The processing circuit 16 is shown schematically in FIG. 6. The analog output signals 32 from the discrete sensor elements pass through an optional operational amplifier where the output signals 32 are amplified. Additional signal conditioning such as filtering and scaling may also occur at this point. The amplified signals enter an analog multiplexer 36 and thereafter an ADC 38 to convert the multiplexed signals to digital data. The digital data is then sampled by a microprocessor 40 and processed to generate information 42 representative of a parameter of interest. The information then passes to a suitable display driver (not depicted) to generate the desired display. The microprocessor 40 includes a clock and communicates with the various hardware in the circuit 16 to control timing and communications within the circuit.

There are multiple channels in the analog portion of the circuit 16, at least one channel for each discrete sensor element and associated output signal 32. Elapsed time for sampling the signals depends on the length of time the club face 124 is in contact with the ball 28 and the portion of the impulse curve which is of interest. As stated hereinabove, this time period is generally on the order of about 0.5 msec. Accordingly, to provide for real-time processing, it is generally desirable that up to all of the sensor channel values be sampled and recorded within this 0.5 msec period. Downstream processing including, for example, digitizing and interpreting the data, may be done after the measured values are recorded. A local cache memory may be provided if the data cannot by processed immediately after being generated.

Microprocessor timing and generation of the display information can lag, since in most cases the golfer will first track the trajectory of the ball visually and will not refer to the display until after the ball has landed. The amount of time available will vary with the club and ball trajectory; however, this interval is contemplated to be on the order of several seconds.

Figure 7:
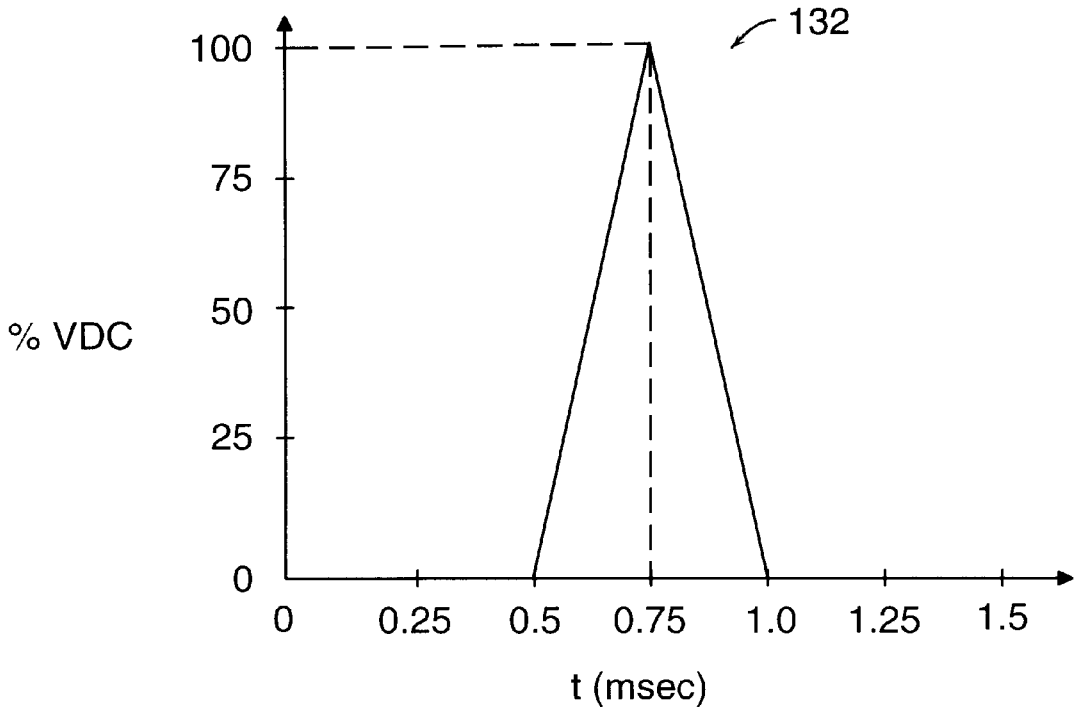
FIG. 7 is a schematic graphical representation of an output signal from a single sensor element upon impact.

The necessity for amplification of the output signals 32 depends on the dynamic range of the electric field intensity of the output signals 32 coming from the piezoelectric transducer 30, or other discrete sensor elements integrated into the club face 124. A typical analog output signal 132 from a piezoelectric sensor element disposed in the club face 124 is depicted in FIG. 7 as a plot of percent direct current voltage (% VDC) as a function of time, t, in msec. The signal 132 shown indicates an initial contact with the ball at about 0.5 msec. The voltage increases for about 0.25 msec to a maximum value, represented here as 100% VDC. Thereafter, the electric field intensity decreases to a value of approximately 67% of maximum VDC and thereafter to zero. While the portion of the output signal 132 used herein is the entire 0.5 msec centered about maximum VDC, the decreasing portion of the signal 132 to 67% VDC and the following drop to zero VDC may be used for certain correlations. A key to determining club head speed however, is the measured maximum value of field intensity, 100% VDC. Due to the high internal impedance of piezoelectric materials, the current generated is small, being on the order of nanoamperes or microamperes; therefore, the power output of the sensor signal 132 is on the order of microwatts to milliwatts. Based on the dynamic range of the output signals 32, amplification may be required which would increases the power required of the batteries 18 to energize the circuit 16.

Since the maximum value of the output signal 132 occurs at about 0.25 msec after initial contact between the club face 124 and the ball 28, output signal sampling need not be delayed after detection of initial contact, but can begin immediately. Accordingly, the ADC 38 is activated to begin conversion of the analog output signals 32.

Sampling rate depends upon ADC operating speed. For example low power semiconductors such as complementary metal oxide silicon (CMOS) ADCs have typical conversion rates in the 10–20 microsecond ($\mu$sec) range; whereas, bipolar ADC devices can convert analog signals much faster, at rates in the range of 20–40 nanoseconds. Accordingly, for a 0.5 msec sampling period and for ten samples each of fifty sensor element output signals, the required sampling rate is about 1 $\mu$sec per sample per sensor or one megasample per second (MSPS). For an ADC with an eight channel input capacity, the fifty sensor channels should be multiplexed in order to capture the desired range of samples. This time interval before digital conversion is not critical and may be assumed to be 0.5 msec as well, requiring each output signal to be multiplexed in about 1 μsec.

For these assumptions, a circuit with forty-nine sensor channels would be multiplexed onto eight ADC channels, or between about six and seven time slots on each ADC input channel. Taking the assumed ten samples per sensor for each of the forty-nine sensors, 490 samples would need to be multiplexed, sampled, and converted into distinct digital data. The ADC timing may vary, but in order to keep the time to a minimum, this conversion process should take no longer than the multiplex time or the transducer real-time to produce the signals. Thus, the ADC should complete its functions in 0.5 msec as well. The ADC may include sample and hold circuitry, as well. The required 1 μsec conversion rate is well within the capability of conventional ADCs such as model numbers AD671 and AD7891 available from Analog Devices, located in Norwood, Mass. 02062.

Impact measurement, signal processing, and information display may be completed sequentially and, for the aforementioned example, takes between about 2.5 msec and about 3.0 msec overall. If sequential processing time for generation of information representative of certain parameters of interest is longer than desired, parallel processing techniques may be employed.

A higher sampling rate is also readily achievable. Using the same 0.5 msec sampling period and fifty samples per sensor element, the sampling circuit has to run at 100,000 samples per second. A cache memory would require 2,450 bits of data for the forty-nine sensor elements and the microprocessor would only need to operate at a sufficiently high bit rate to process these 2,450 bits and produce a display of the particular impact within a reasonable amount or time for the golfer to complete his swing and look for the result in the display. A basic period of one second could be used for translation and display of the results. Thus, the microprocessor need only operate at a speed of less than 100 KHz, which is well within the capability of conventional microprocessors.

As mentioned hereinabove, any of a variety of displays 22 may be employed to present the parameter of interest information to the golfer including digital alpha-numeric and graphic character displays. Such displays 22 can be produced from LEDs, LCDs, injection lasers, or other display devices which can be configured in suitable geometries. A conventional seven segment LED or LCD could be used for the alpha-numeric characters; however, a graphical display such as the impact angle arrow may be provided. In general, a light weight, low power, suitably sized display 22 is preferred. Optical contrast of the displayed characters in strong ambient light conditions such as sunlight is also a factor, which tends to suggest LCD displays such as those employed in wrist watches.

A twenty character LCD display operates on a current of less than about 10 μA. If powered by a 3 VDC battery, the twenty character LCD would require no more than about 0.6 mW. LED displays, on the other hand, typically require more current, operating in the 3 mA to 5 mA range, requiring between about 180 mW and 300 mW for a similar multi-character display capability.

An exemplary calculation of peak power required by an instrumented golf club according to the invention for a measurement, signal processing, and display yields a range of between about 150 mW and about 500 mW per impact, depending upon the overall design configuration assumptions. An operational amplifier, if required, would consume between about 80 mW and 150 mW, an analog multiplexer about 10 mW, an ADC between about 80 mW and 150 mW, a microprocessor between about 10 mW and 100 mW, and a multi-character display between about 50 mW and 100 mW.

A cluster configuration of two standard size (½ AA) 3.6 volt lithium batteries can deliver upwards of 100 mA of peak current drain, providing over 360 mW of power. Suitable batteries are model T1-2150 Lithium Xrta™ manufactured by Tadiran, Inc., located in Tel Aviv, Israel, and available domestically from DC Battery Distributors, Minneapolis, Minn. 55413. These or similar batteries would furnish sufficient power for the minimum power requirement. Adding another two batteries in parallel would increase the continuous current drain capability to 200 mA, delivering 720 mW of power to cover the maximum power requirement. Available battery options are numerous and need only to be matched to the power required by the circuitry for a particular application.

Figure 8A:
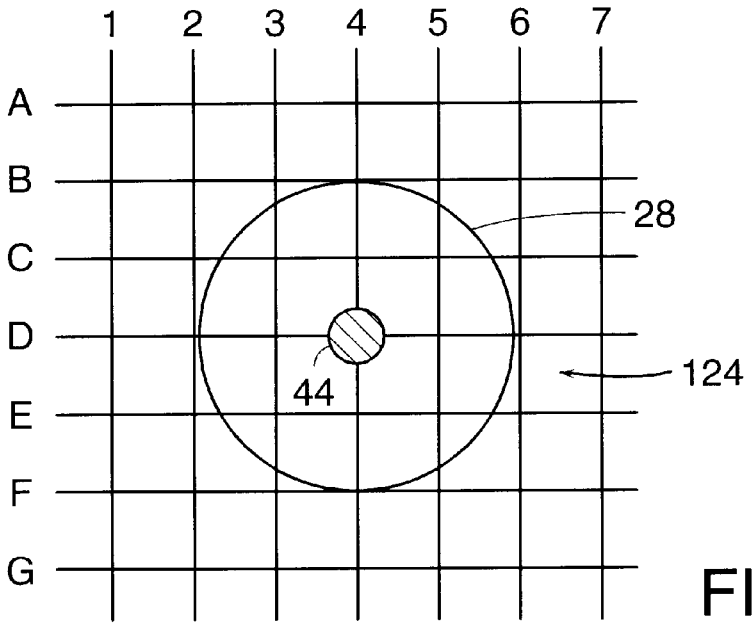
FIGS. 8A–8B are schematic graphical representations of spatial locations of transducer output signals upon initial contact and impact progression.
Figure 8B:
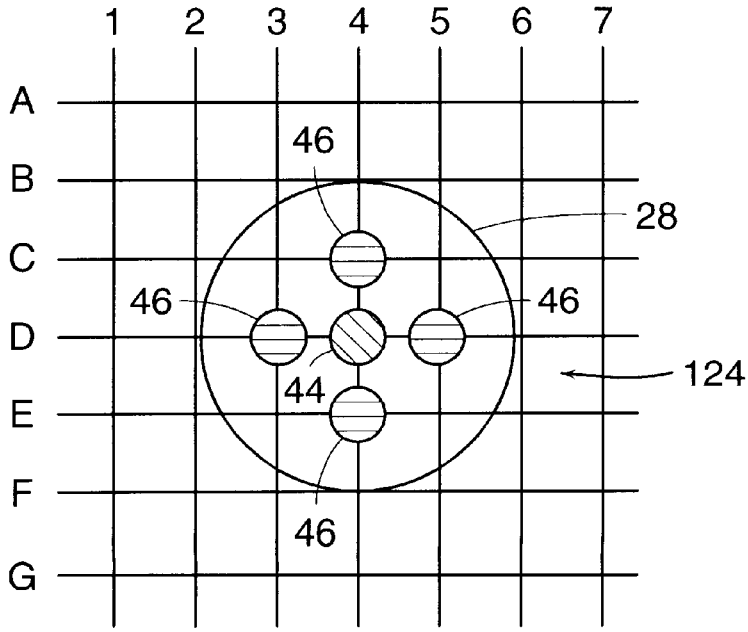

Various algorithms and methodologies may be employed to generate information representative of one or more parameters of interest based upon the sampled digital data. Depicted in FIGS. 8A–8B are schematic representations of spatial locations of transducer output signals upon initial contact and impact progression of the ball 28 by the club face 124. The array of forty-nine discrete sensor elements is represented by the intersections of the seven horizontal lines designated A–G and the seven vertical lines designated 1–7. Upon initial contact between the club face 124 and the ball 28 depicted in FIG. 8A, contact is limited to a single location, shown as the enlarged dot 44 at the center of the ball 28. This location corresponds to sensor element D4 in the array. As the club head 20 continues along the path of travel T through the swing as depicted in FIG. 8B, the ball 28 deforms elastically, flattening around the primary point of contact 44 and imparting additional local forces to the club face 124 as depicted by the four circumferentially disposed dots 46 depicted in FIG. 8B. These secondary point of contact locations 46 correspond to sensor elements C4, D3, D5, and E4. Upon leaving the club face 124, the ball 28 regains its spherical contour. Clearly, depending on the density of the array of sensor elements, the degree of deformation of the golf ball 28, and the transmission of the induced impulse force through the club face 124, many more than five of the forty-nine sensor elements will produce respective output signals.

Referring once again to FIG. 8A, the primary point of contact 44 between the ball 28 and the club face 124 is located at D4, the center of the club face. As soon as contact is detected, the circuit 16 can begin sampling all forty-nine sensor element output signals 32 or, alternatively, may initiate a predetermined delay, as desired. As the club head advances through the swing, the ball 28 deforms and the impact spreads to the secondary points of contact 46. Accordingly, for the entire sampling period, the output signals 32 of all of the forty-nine sensor elements are being sampled at predetermined intervals. Since the force levels imparted to different areas of the club face 124 are different, respective output signals 32 exhibit different time-varying magnitudes and durations. For example, for the simplified example depicted in FIGS. 8A–8B, both the magnitude and duration of the output signal 32 of sensor element D4 will be greater than those of sensor elements C4, D3, D5, and E4 and none of the other forty-four sensor elements will generate output signals.

Once the sampling period has run, the digital data is manipulated by the microprocessor 40 to generate information representative of the parameters of interest. Depending on the parameter, the primary point of contact 44 and some or all of the subsequent points of contact may be utilized. FIGS. 9A and 9B are schematic matrix representations 48*a,* 48*b* of the digital data for each sensor element in the array for two different impact conditions. The values in the matrices 48*a,* 48*b* are dimensionless and representative of relative output signal magnitude for the respective sensor elements.

Referring first to matrix 48*a* of FIG. 9A, this representation is exemplary of a force matrix at a point in time after initial contact of the club face 124 with the ball 28 after elastic deformation has begun. This is evident due to both the relatively large number of fifteen output signal samples of the forty-nine possible, as well as the distribution and values of the samples in the array. More specifically, the maximum value in the array of 80 occurs at sensor element D4 which is the center of the club face 124, with secondary values being substantially symmetrically disposed about column 4. This is indicative of a center hit on the club face 124 with an orthogonal impact angle. Accordingly, the ball 28 would be expected to have a straight trajectory without any side spin and resultant hook or slice. There is, however, a general asymmetry about row D, with a greater number of samples with higher values above row D than below row D. This pattern may be interpreted as contact with the ball 28 slightly below the horizontal centerline, inducing a slight back spin in the ball 28 and causing a more pronounced vertical trajectory of the ball 28 and shorter travel distance. Alternatively, the matrix 48*a* could represent an average of some or all of the samples for each of the sensor elements, maximum values, or cumulative values.

Depending on the parameters of interest, correlations can be drawn to the force matrices whether they are of single sampling events or the maximum, average, or cumulative values of some or all sampling events. For example, impulse duration, which may be used to calculate impulse force F, is determined by the number of sampling events producing measurable data. The maximum data may be used to determine club head impact speed and impact elevation of the ball 28 on the club face 124. The distribution of the average data may be used to determine impact angle and resultant straightness, hook, or slice. Analysis of the distribution of the data may be by algorithm or comparison of the distribution pattern to a plurality of predetermined commonly expected patterns stored in memory in the circuit 16.

FIG. 9B depicts a force matrix 48 b resulting from a different condition than that depicted in FIG. 9A. Here, the initial impact occurred at sensor element F5, the location of the maximum value of 85 in the matrix 48*b*. The ball 28 was struck by the bottom of the toe of the club face 124 and above the horizontal centerline H of the ball 28. This golf swing appears to have been poorly executed since the are only five secondary sensor elements registering any appreciable force. Because the ball 28 was struck with the bottom of the club face 124 there are no forces registered by the sensor elements in row G, below the point of initial contact. Also, because the ball 28 was struck off of the bottom edge of the toe of the club face 124, this would cause what is typically known as a "shank" shot, where the ball 28 comes off of the club face 124 with little side spin, but in a severe left-to-right path, decidedly off the target trajectory. This display 22 would indicate to the golfer that the club head came from outside-in, by means of an angled arrow. Since the ball 28 was struck so far above the horizontal centerline H, the bottom edge of the club face 124 contacted the ball 28 initially. The golfer needs to "keep his head down" to ensure contacting the ball 28 at the proper club face elevation.

As mentioned hereinabove, interpretation of the force matrix distribution patterns can be accomplished by a variety of methods. Algorithms, for example, may be employed to generate a common force value based upon all of the force values in the matrix 48 during a given sampling period; however, such calculations could be time consuming and burden the microprocessor 40. A simple, accurate method for calculating a force average entails averaging all of the samples from each sensor element over a predetermined sampling period. For example, if one of the secondary sensor elements registered forces of 35, 33, 30, 25, and 20 units each for five time samples, then the average force for that sensor element would then be the sum of these samples divided by five, or 29 units. If the force for that same sensor element diminished faster, then the average will be less than 29 units.

This method has the advantage that the calculation can be executed quickly by the microprocessor 40 and is relatively easy to perform with standard electronic components. Averaging could be employed only on the secondary sensor elements, as the primary sensor element is used for its maximum value to calculate club head speed.

In practice, therefore, it is desirable to use a number of sensor elements integrated into the club face 124 adequate to capture sufficient information concerning primary and secondary points of contact 44, 46. A forty-nine sensor element array is presented here for illustrative purposes for use on a golf club face 124; however, fewer and more sensor elements and different distribution patterns are considered to be within the scope of the invention.

Benefits of the method and apparatus of the invention are multiple. First, the instrumented sports apparatus is entirely self-contained. In the golfing application, the golf club 10 can be used during play on the golf course. Being portable, the club 10 has the advantage over external training devices that the golfer can receive immediate feedback while using the club in actual play. Swing memory, the golfer's retention of proper swing positioning, is required for only the time it takes to read the display and take the next swing, resulting in a significant advantage over external devices which precede actual play by hours or days. Second, by using the high density, multiple element transducer 30, a wealth of data about each golf swing can be acquired, affording the display of a wide variety of parameters of interest and providing to the golfer a comprehensive analysis of his swing positions and club head speed and direction. Finally, the golf club 10 does not require a fixed frame of reference each time the club 10 is swung, unlike many training devices which require the golfer to position himself in a specific manner with respect to the device each time the ball is struck. There is no need for any specific address position. The golfer simply takes his stance and addresses the ball as he would in a normal golf swing while playing on the course. This is important, because the golfer's position while using the golf club 10 during actual play is the closest simulation possible, allowing the golfer to adjust his swing to the desired position with confidence.

As indicated above, the teachings herein can be applied to a variety of contact sports apparatus including tennis, squash, and racquetball racquets, paddle ball, paddle tennis, and table tennis paddles, as well as baseball, softball, and cricket bats and other sticks and mallets.

While there have been described herein what are to be considered exemplary and preferred embodiments of the present invention, other modifications of the invention will become apparent to those skilled in the art from the teachings herein. It is therefore desired to be secured in the appended claims all such modifications as fall within the true spirit and scope of the invention. Accordingly, what is desired to be secured by Letters Patent is the invention as defined and differentiated in the following claims.

What is claimed is:

1. A method of providing feedback to a user of a sports apparatus having a surface for impacting an object the method comprising the steps of:

measuring an impact of the object at a plurality of discrete points on the surface of the apparatus using a high density point sensor array transducer for generating a plurality of respective output signals corresponding to primary and secondary points of contact with the object, each output signal having a magnitude and a duration, resulting in a force distribution pattern;

processing the respective output signals; and displaying a parameter of interest corresponding to the respective output signals based at least in part on stored data related to expected force distribution patterns.

2. A method according to claim 1 wherein the processing step comprises the steps of:

multiplexing the respective output signals;

converting the multiplexed signals to digital data; and generating information representative of a parameter of interest based upon the digital data.

3. A method according to claim 2 wherein the processing step further comprises the step of amplifying the respective output signals.

4. A method according to claim 2 wherein the information generating step comprises the steps of:

sampling the digital data corresponding to each signal;

averaging the sampled data corresponding to each signal; and comparing a distribution of the averaged data to the stored data.

5. A method according to claim 4 wherein the parameter of interest is impact angle.

6. A method of providing feedback to a user of a sports apparatus having a surface for impacting an object, the method comprising the steps of:

measuring an impact of the object at a plurality of discrete points on the surface of the apparatus using a high density point sensor array transducer for generating a plurality of respective output signals corresponding to primary and secondary points of contact with the object, each output signal having a magnitude and a duration, resulting in a force distribution pattern;

processing the respective output signals by:

multiplexing the respective output signals;

converting the multiplexed signals to digital data; and generating information representative of a parameter of interest based upon the digital data, wherein the information generating step comprises the steps of:

sampling the digital data corresponding to each signal; and determining a maximum value of all of the sample data; and displaying a parameter of interest corresponding to the respective output signals.

7. A method according to claim 6 wherein the parameter of interest is selected from the group consisting of impact speed and impact location.

8. A method according to claim 1 wherein the parameter of interest is displayed graphically.

9. A method according to claim 1 wherein:

the sports apparatus comprises a golf club having a club head;

the transducer comprises a piezoelectric film;

the surface comprises a face of the club head;

the object comprises a golf ball; and the parameter of interest is selected from the group consisting of club head speed, club head angle, and club head elevation.

10. A sports apparatus comprising:

a surface for impacting an object;

a transducer coupled to the surface, the transducer comprising a high density array of discrete point sensors, wherein each of a plurality of neighboring point sensors generates a respective output signal having a magnitude and a duration corresponding to a local impact of the surface by the object corresponding either to a primary or a secondary point contact, resulting in a force distribution pattern;

a circuit for processing the respective output signals, the circuit including memory for storing data related to expected force distribution patterns; and a display for displaying a parameter of interest corresponding to the respective output signals.

11. An apparatus according to claim 10 wherein the circuit comprises:

an analog multiplexer for multiplexing the respective output signals;

an analog to digital converter for converting the multiplexed signals to digital data; and a processor for processing the digital data and generating information representative of a parameter of interest.

12. An apparatus according to claim 11 further comprising an amplifier for amplifying the respective output signals.

13. An apparatus according to claim 10 wherein the parameter of interest is selected from the group consisting of impact speed, impact angle, and impact location.

14. An apparatus according to claim 10 further comprising a battery for powering the circuit.

15. An apparatus according to claim 10 wherein the parameter of interest is displayed graphically.

16. An apparatus according to claim 10 wherein:

the sports apparatus comprises a golf club having a club head;

the transducer further comprises a piezoelectric film;

the surface comprises a face of the club head;

the object comprises a golf ball; and the parameter of interest is selected from the group consisting of club head speed, club head angle, and club head elevation.

17. A method of instrumenting a surface of a sports apparatus the method comprising the steps of:

providing a transducer comprising a high density array of discrete point sensors; and integrating the transducer into the sports apparatus such that:

the transducer is coupled to the surface; and the transducer is protected from direct impact of an object to be impacted by the surface.

18. A method according to claim 17 wherein the transducer further comprises a piezoelectric film.

19. A method according to claim 17 wherein the transducer is coupled to the surface by bonding.

* * * * *